United States Patent [19]

Koros

[11] 4,266,969

[45] May 12, 1981

[54] DESULFURIZATION PROCESS

[75] Inventor: Peter J. M. Koros, Pittsburgh, Pa.

[73] Assignee: Jones & Laughlin Steel Corporation, Pittsburgh, Pa.

[21] Appl. No.: 114,262

[22] Filed: Jan. 22, 1980

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,929,464 | 12/1975 | Todd | 75/53 |
| 3,953,198 | 4/1976 | Easwaran | 75/53 |
| 3,957,502 | 5/1976 | Cull | 75/58 |
| 3,980,469 | 9/1976 | Forster | 75/53 |
| 3,998,625 | 12/1976 | Koros | 75/53 |
| 4,014,684 | 3/1977 | Jones | 75/53 |
| 4,076,522 | 2/1978 | Yoshida | 75/58 |
| 4,083,716 | 4/1978 | Yoshida | 75/58 |
| 4,159,906 | 7/1979 | Meichsner | 75/58 |
| 4,162,917 | 7/1979 | McWhorter | 75/58 |

FOREIGN PATENT DOCUMENTS

| | | | |
|---|---|---|---|
| 2301987 | 7/1974 | Fed. Rep. of Germany | 75/58 |

*Primary Examiner*—P. D. Rosenberg
*Attorney, Agent, or Firm*—Robert D. Yeager

[57] ABSTRACT

A process for desulfurizing a bath of molten iron contained in a vessel comprising the steps of injecting particulate lime and a carbon-containing particulate with a non-oxidizing carrier gas beneath the surface of the bath to remove sulfur from the iron, while controlling the rate of injection of the carbon-containing particles to prevent substantial ejection of the bath from the vessel. The preferred carbon-containing materials are graphite and a compound containing at least carbon and hydrogen in proportions ranging from $CH_{>0}$ to $CH_2$. The preferred carrier gas is a hydrocarbon gas.

7 Claims, No Drawings

DESULFURIZATION PROCESS

BACKGROUND OF THE INVENTION

1. Field of the Invention

This invention relates to the desulfurization of molten ferrous metals; more particularly to the controlled injection of a mixture of non-oxidizing material and carbon-containing particles into molten iron to achieve desulfurization.

2. Description of the Prior Art

The present invention is an improvement of the invention disclosed and claimed in U.S. Pat. No. 3,998,625, which is owned by the assignee of this application and which is incorporated by reference herein.

U.S. Pat. No. 3,998,625 discloses a desulfurization process in which a particulate non-oxidizing material such as lime and particulate magnesium-containing material are separately fed from their respective storage means to form a fluidized mixture in a non-oxidizing carrier gas and this mixture is injected into a molten ferrous metal. The magnesium component of the injected mixture serves as a potent desulfurization agent in the ferrous metal. A principal advantage of the process taught in U.S. Pat. No. 3,998,625 is that the injection rate of magnesium-containing material may be varied during the injection period to take into account process variables such as the fact that the efficiency of magnesium desulfurization decreases as the sulfur content of the bath decreases.

The lime/magnesium process disclosed in U.S. Pat. No. 3,998,625 has proven to be a commercial success. However, the magnesium-containing component used in the process is relatively expensive and this factor prompted further efforts by workers in the art to reach a less expensive but equally effective desulfurization method.

West German Offenlegungsschrift No. 2,301,987 describes a desulfurization process in which fine lime and finely granulated saturated hydrocarbons are mixed and then injected into molten iron, preferably with a carbon monoxide-containing carrier gas. The Offenlegungsschrift teaches that the lime/hydrocarbon mixture should contain about 5% hydrocarbons by weight but that the proportion may go as high as 20% by weight.

In a later filed West German application by the same applicant, Offenlegungsschrift No. 2,337,957, an alleged improvement of the lime/hydrocarbon injection process is described; the improvement consists of coating the fine lime particles with the hydrocarbons. Again it is stated that the coated lime particles should contain hydrocarbons in the range of 5 to 20% by weight.

Neither of the West German Offenlegungsschrifts specifies a particular hydrocarbon for use in the process; the suitable hydrocarbons are described only by reference to the formula $C_nH_{2n+2}$, which identifies a saturated hydrocarbon from the alkane family. Further, neither Offenlegungsschrift mentions any proportions of lime or hydrocarbon in relationship to the quantity of molten iron to be desulfurized; nor is any mention made of injection rates or other process operating parameters.

It has been found that the introduction of solid hydrocarbons mixed with finely divided lime into a molten iron bath tends to produce violent agitation within the bath when the hydrocarbon injection rates are relatively high; if the molten iron is carried in a conventional submarine ladle, this agitation manifests itself as undesirable splashing or slopping when the ladle is filled to design capacity. The cause of this violent agitation is the dissociation of the hydrocarbon when it contacts the molten bath and attendant release of hydrogen gas within the bath.

If, for example, a simple conversion from the lowest recommended weight percent taught by the above-referenced Offenlegungsschrifts, 5% by weight, to a hydrocarbon injection rate can be made, that weight percent represents a hydrocarbon injection rate of about 6.8 lb./min. based on a lime injection rate of 130 lb./min.; this lime injection rate, according to U.S. Pat. No. 3,998,625, is deemed desirable for smooth operation in desulfurizing pig iron having typical sulfur contents. Injecting hydrocarbon, for example polypropylene, at a rate of over 6 lb./min. results in splashing within the ladle that can be tolerated only by a drastic reduction in the quantity of molten metal carried in the ladle. The even higher hydrocarbon injection rates that would result from observing the upper end of the hydrocarbon weight percent range suggested in the German process are clearly inappropriate.

A process using polypropylene mixed with lime would, if the German teachings were observed, involve an additional disadvantage. U.S. Pat. No. 3,998,625 teaches that the lime particles preferably should be sized so that 98% are less than about 44 microns. If the German teaching is followed, specifically the teaching that the solid hydrocarbons and the fine lime should have approximately the same grain size, preferably less than 1 mm, the polypropylene particles should be substantially of the same size. But when the grain size of polypropylene is reduced below about 75 microns, the material is pyrophoric and a dust explosion hazard is presented.

SUMMARY OF THE INVENTION

The present invention overcomes the disadvantages of the prior art ferrous metal desulfurization practices by providing a process which effectively desulfurizes molten ferrous metal while optimizing operating efficiencies and material cost. The process is effective in desulfurizing molten pig iron that has a sulfur content of 0.060% or less, and is particularly effective at sulfur contents of 0.040% and below.

The present invention is intended for use in a process of the type described in U.S. Pat. No. 3,998,625 in which a fluidized mixture of particulate lime and other active agent is formed in a non-oxidizing carrier gas and the mixture thereafter is injected beneath the surface of a sulfur-containing molten ferrous metal being carried in a refractory-lined holding vessel. It has been found that natural gas is a particularly effective carrier gas for reasons discussed hereinafter. The component mixed with lime in the present invention is a carbon-containing particulate capable of reducing the lime (CaO) to yield free calcium which combines with sulfur in the molten metal. The sulfur removal process of the invention may be represented generally by the following:

$$CaO + C \rightarrow CO + Ca \text{ (in hot metal)} \quad (1)$$

$$Ca \text{ (in hot metal)} + S \text{ (in hot metal)} \rightarrow CaS \text{ (to slag)} \quad (2)$$

The carbon-containing particulate used in the process of the present invention preferably in graphite, but also may be a compound containing carbon that dissociates upon contact with molten iron to yield free carbon. If, upon such dissociation, the other constituent(s) yields an essentially non-reactive gas, as with hydrocarbons for example, a beneficial stirring effect is produced in the iron bath. Thus, in addition to graphite, compounds containing at least carbon and hydrogen is proportions ranging from $CH_{>0}$ to $CH_2$ may be used as the carbon-containing particulate. Exemplary of such compounds are hydrocarbons including specifically polypropylene and hydrocarbon resins.

When graphite is used as the carbon-containing particulate, graphite may be injected into the sulfur-containing metal at a rate of up to 20 weight percent of the lime injection rate, preferably in the range of 5 to 12% of the lime rate. When hydrocarbons are used as the carbon-containing agent, a lower injection rate, in a range up to 5% of the lime rate, should be observed, preferably in the range of 3 to 4% of the lime rate. This lower injection is necessary to avoid excessive agitation of the bath caused by the release of hydrogen gas and consequent ejection of metal and slag from the treatment vessel. In this regard, the practical maximum hydrogen release rate that can be tolerated in the process of the present invention is less than 1.0% by weight of the lime rate, preferably about 0.7%.

The present invention provides a process for desulfurizing a bath of molten iron contained in a vessel comprising the steps of: injecting particulate lime and a carbon-containing particulate with a non-oxidizing carrier gas beneath the surface of the bath to remove sulfur from the iron, while controlling the rate of injection of the carbon-containing particles to prevent substantial ejection of the bath from the vessel. The expression "substantial ejection of the bath" as used herein means an amount of ejecta sufficient to pose either the risk of injury to personnel operating the process or the risk of damage to the equipment used in carrying out the process.

Other details and advantages of the present invention will be apparent to those skilled in the art from the following detailed description.

DESCRIPTION OF THE PREFERRED EMBODIMENTS

The process of the present invention is practiced with equipment and injection procedures substantially in accordance with those described in U.S. Pat. No. 3,998,625. In the present invention, a solid carbon-containing material is substituted for the magnesium-containing material described in that patent and, of course, different injection rates of carbon-containing material are observed.

The use of graphite as the carbon-containing agent offers a number of advantages including low cost and safe handling characteristics. The slag formed in the lime/graphite injection process is granular in form and, therefore, is easier to remove from the molten metal vessel than the slag resulting from the desulfurization process described in U.S. Pat. No. 3,998,625. Graphite also tends to act as a flow stabilizer for lime and thus may permit a decrease in the amount of agent needed to impart flowability to lime.

Although the process of U.S. Pat. No. 3,998,625 teaches the use of separate dispensers for the two constituents of the injection mixture, the use of graphite as the carbon-containing particulate of the present invention may permit premixing of the lime and graphite, by co-pulverizing, owing to the similarity in grindability exhibited by the two materials. In such case, an operator of the process of the present invention could carry out the process with a single dispenser. The preferred particle size of graphite is that size that permits safe handling and storage of the graphite; i.e. a non-pyrophoric material.

Graphite offers the still further advantage of not reacting violently when introduced into molten ferrous metal. Accordingly, the slopping often associated with injection desulfurization processes is not promoted by the use of graphite. As alluded to above, however, it is desirable to provide a means for mild stirring of the molten iron bath during the process of the present invention in order to assure that all portions of the bath are exposed to the desulfurizing action of the injected lime.

Because graphite provides no gas generation upon contact with molten iron, it has been found desirable to use a gas that dissociates upon contact with molten iron, preferably a hydrocarbon gas, still further preferably natural gas, as the carrier gas for the lime/graphite particles. Natural gas dissociates to yield hydrogen gas which serves to agitate the bath as the released gas passes upwardly therethrough. The dissociation of natural gas also produces a further source of carbon to supplement the injected graphite. Nitrogen gas is also suitable as a carrier gas because it provides some bath agitation, but the use of nitrogen is less desirable because it does not dissociate and, of course, provides no source of carbon. The rate of injection of carrier gas in the process of the present invention should be that rate which provides adequate stirring of the bath but not so much agitation that metal or slag is ejected from the treatment vessel.

The requirement for agitating the bath during the process of the present invention is met when the injected carbon-containing particulate itself dissociates to release a gas. Thus, a material containing carbon and hydrogen, wherein the relationship of these constituents varies from $CH_{>0}$ to $CH_2$, is useful in the present invention. Exemplary of these materials are polymeric hydrocarbons such as polypropylene $[CH_3—(CH_2)_n—CH_3]$ and polystyrene $[(C_8H_8)_n]$, certain hydrocarbon resins, e.g. $(C_{10}H_9)_n$, ethylcellulose $[(C_{11}H_2O_5)_n]$, and polycarbonates $[(C_{16}H_{14}O_3)_n]$. Generally, the shorter the chain length of the foregoing compounds, the better will be the performance of the process.

In the use of carbon/hydrogen compounds with the present invention, a practical limit on the rate of hydrogen release compared with the lime rate has been observed to be about 1% by weight, preferably about 0.7%. For example, when a charge of 160 NT of hot metal is treated with 100 lbs./min. of lime, only about 0.7 lb./min. of hydrogen gas released in the bath may be tolerated.

The use of powdered polypropylene as the carbon/-hydrogen compound in the present invention offers the advantages of low cost, good availability, excellent flowability and safety. Further, the reaction products of the constituents of polypropylene (CO, $CO_2$ and $H_2$) leave the molten bath as gases and thereby do not contribute additional substances to the metal for eventual handling or removal. Care must be exercised with polypropylene, however, with respect to its particle size because, as stated above, polypropylene having a grain size below about 75 microns is deemed to be pyrophoric. Thus, a preferred grain size for polypropylene is about 100 microns or greater.

In carrying out the desulfurization process of the present invention, a submarine ladle of molten pig iron is spotted beneath the injection lance. After any necessary deslagging and testing are completed, the lance is submerged into molten iron to a depth such that the lance tip opening is about 1 ft. above the ladle bottom. Lime injection is commenced and brought to the maximum rate permitted by iron splashing. This rate may vary between 80 and 180 lb./min. for a pig iron charge of 160±20 net tons in the submarine ladle; preferably the lime injection rate for that size charge ranges from 90 to 120 lb./min. Then, the injection of carbon-containing particulate is commenced and brought to a rate that maintains a smooth, splash-free molten metal surface. For graphite, this rate will range up to 20% of the lime rate, preferably from 5 to 12%. For powdered polypropylene, the injection rate will range from 1 to 5% of the lime rate, preferably from 3 to 4%. After the predetermined amounts of lime and carbon-containing material are delivered to the metal, the injection of carbon-containing material is stopped, the lance is raised and the injection of lime is slowed to stop as the lance mouth breaks through the slag layer on the metal. After any necessary deslagging and testing is completed, the desulfurized hot metal is dispatched to refining operations.

In the following tables, the results of a number of desulfurization operations carried out in accordance with the foregoing procedures are tabulated:

TABLE I

LIME - GRAPHITE

| Test No. | Sulfur Start | Sulfur Finish | Hot Metal Net Tons | Lime Total Lbs. | Lime Lbs. Min | Graphite Total Lbs. | Graphite Lbs. Min. | Desulf. Efficiency Of Lime, % |
|---|---|---|---|---|---|---|---|---|
| 543 | .060 | .025 | 140 | 2300 | 92 | 157 | 6.3 | 7.5 |
| 540 | .033 | .013 | 158 | 1500 | 71 | 82 | 6.3 | 7.0 |
| 546 | .042 | .018 | 153 | 2070 | 94 | 88 | 5.9 | 6.2 |
| 1011-02* | .025 | .018 | 155 | 1800 | 106 | 0 | 0 | 2.1 |
| 1211-10 | .041 | .021 | 168 | 2400 | 96 | 120 | 4.8 | 4.9 |
| 2111-11 | .026 | .010 | 153 | 2100 | 117 | 120 | 6.7 | 4.1 |
| 0511-09 | .040 | .004 | 165 | 2500 | 109 | 140 | 6.1 | 8.3 |
| 0111-13 | .113 | .045 | 145 | 2880 | 96 | 144 | 4.8 | 9.2 |
| 1811-14 | .087 | .050 | 155 | 1750 | 92 | 200 | 10.5 | 2.8 |
| 1311-13 | .032 | .021 | (135) | 1330 | 89 | 262 | 17.5 | 3.9 |
| 1411-12 | .023 | .012 | 153 | 1350 | 113 | 40 | 3.3 | 4.3 |
| 0811-02 | .028 | .017 | 160 | 1900 | 95 | 50 | 2.5 | 3.2 |

( )- Outside Limits
*- Reference

TABLE II

LIME - POLYPROPYLENE

| Test No. | Sulfur Start | Sulfur Finish | Hot Metal Net Tons | Lime Total Lbs. | Lime Lbs. Min. | Poly-propylene Total Lbs. | Poly-propylene Lbs. Min. | Desulf. Efficiency of Lime, % |
|---|---|---|---|---|---|---|---|---|
| 049 | .038 | .022 | 153 | 2140 | 116 | 14 | 0.8 | 4.0 |
| 054 | .044 | .019 | 155 | 1820 | 126 | 16 | 1.2 | 7.5 |
| 058 | .026 | .014 | 167 | 930 | 113 | 11 | 2.2 | 7.5 |
| 069* | .041 | .022 | 158 | 3050 | 139 | 0 | 0 | 3.4 |
| 084 | .052 | .030 | 156 | 1660 | 101 | 28 | 2.0 | 7.2 |
| 097 | .022 | .003 | 156 | 2530 | 100 | 65 | 2.8 | 4.1 |
| 098 | .026 | .010 | 151 | 2050 | 94 | 65 | 3.3 | 4.1 |
| 133 | .047 | .027 | 148 | 1850 | 95 | 81 | 4.2 | 5.6 |

*Reference

Lime efficiency, as used in the Tables above, is a relative measure of how well the carbon-containing material reacted with the lime to effect desulfurization in accordance with formulae (1) and (2) above. Lime efficiency is calculated by converting the weight of sulfur removed to moles of sulfur removed and then dividing into that figure the moles of lime introduced into the bath. For example, for Test No. 543 of Table I, 0.035% sulfur was removed from 140 tons of hot metal; 0.035% sulfur equals 3.06 moles of sulfur. The 2300 lbs. of lime consumed in that test equals 41.07 moles of lime. Therefore:

$$\frac{3.06}{41.07} \times 100 = 7.5\% \text{ Lime Efficiency}$$

It has been found that lime efficiencies ranging between about 5 and 10% presently offer the best all-around performance in the process of the invention; the higher the value, of course, the better the performance.

What is claimed is:

1. A process for desulfurizing a bath of molten iron contained in a vessel comprising the steps of:

injecting particulate lime and a carbon-containing particulate with a non-oxidizing carrier gas beneath the surface of said bath to remove sulfur from said iron, while controlling the rate of injection of said carbon-containing particles to prevent substantial ejection to said bath from said vessel.

2. The process recited in claim 1 wherein:

said carbon-containing particulate is graphite and the injection rate thereof is controlled to range up to about 20% of the lime injection rate.

3. The process recited in claim 2 wherein:

said graphite injection rate is controlled to range from about 5 to 12% of the lime injection rate.

4. The process recited in claim 1 wherein:

the carbon-containing particulate is a compound containing at least carbon and hydrogen in proportions ranging from $CH_{>0}$ to $CH_2$; and the injection rate of said compound is controlled to release hydrogen gas in said bath at a rate not to exceed about 1% by weight of said lime injection rate.

5. The process recited in claim 4 wherein:

said compound containing at least carbon and hydrogen is polypropylene; and said hydrogen release rate does not exceed about 0.7% by weight of said lime injection rate.

6. The process recited in claim 5 wherein:

said polypropylene has an average grain size greater than about 75 microns.

7. The process recited in any one of claims 1, 2 or 4 wherein:

the non-oxidizing carrier gas is a hydrocarbon gas.

* * * * *

UNITED STATES PATENT AND TRADEMARK OFFICE

CERTIFICATE OF CORRECTION

PATENT NO. : 4,266,969

DATED : May 12, 1981

INVENTOR(S) : Peter J. M. Koros

It is certified that error appears in the above-identified patent and that said Letters Patent are hereby corrected as shown below:

Col. 2, line 64, delete "in" and substitute therefor --is--;

Signed and Sealed this

*Twenty-eighth* Day of *July 1981*

[SEAL]

*Attest:*

GERALD J. MOSSINGHOFF

*Attesting Officer*

*Commissioner of Patents and Trademarks*